US011651666B2

(12) United States Patent
Dougan

(10) Patent No.: US 11,651,666 B2
(45) Date of Patent: May 16, 2023

(54) ATTEMPTED ENTRY DETECTION

(71) Applicant: Alarm.com Incorporated, Tysons, VA (US)

(72) Inventor: Connor Dougan, Lone Tree, CO (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 17/154,482

(22) Filed: Jan. 21, 2021

(65) Prior Publication Data

US 2021/0248884 A1 Aug. 12, 2021

Related U.S. Application Data

(60) Provisional application No. 62/975,460, filed on Feb. 12, 2020.

(51) Int. Cl.
*G08B 13/08* (2006.01)
*G08B 13/196* (2006.01)
*G08B 13/16* (2006.01)

(52) U.S. Cl.
CPC ..... *G08B 13/08* (2013.01); *G08B 13/1663* (2013.01); *G08B 13/1961* (2013.01)

(58) Field of Classification Search
CPC ... E05B 45/12; G08B 13/19613; G10L 25/51; G07C 2009/00746; H04L 12/2823; H04L 12/2829
See application file for complete search history.

(56) References Cited

U.S. PATENT DOCUMENTS

| | | | | |
|---|---|---|---|---|
| 9,159,219 | B2 | 10/2015 | Magner et al. | |
| 9,447,609 | B2 | 9/2016 | Johnson et al. | |
| 2009/0027196 | A1* | 1/2009 | Schoettle | G08B 13/10 340/541 |
| 2015/0109112 | A1* | 4/2015 | Fadell | G08B 19/005 340/328 |
| 2016/0047145 | A1 | 2/2016 | Johnson et al. | |
| 2017/0365161 | A1* | 12/2017 | Rabb | G08B 29/188 |
| 2018/0298640 | A1 | 10/2018 | Caterino | |
| 2019/0371139 | A1* | 12/2019 | Engler | G08B 13/126 |
| 2021/0194718 | A1* | 6/2021 | Scalisi | H04M 11/025 |

* cited by examiner

*Primary Examiner* — Mirza F Alam
(74) *Attorney, Agent, or Firm* — Fish & Richardson P.C.

(57) ABSTRACT

Methods, systems, and apparatus for attempted entry detection are disclosed. A method for monitoring a property includes receiving, from a smart lock of a door located at a property monitored by a monitoring system, smart lock data that reflects a condition of the smart lock; receiving, from a sensor of the monitoring system, sensor data; analyzing the smart lock data and the sensor data; based on analyzing the smart lock data and the sensor data, determining that an attempted door entry is occurring; and in response to determining that an attempted door entry is occurring, performing a monitoring system action. Determining that an attempted door entry is occurring can include determining, based on the sensor data, that a person is located near the smart lock; and determining, based on analyzing the smart lock data, that the smart lock data satisfies criteria for an attempted door entry.

19 Claims, 4 Drawing Sheets

ATTEMPTED ENTRY DETECTION

CROSS-REFERENCE TO RELATED APPLICATIONS

This application claims the benefit of the U.S. Provisional Patent Application No. 62/975,460 filed Feb. 12, 2020, which is incorporated herein by reference in its entirety.

TECHNICAL FIELD

This disclosure application relates generally to property monitoring systems with smart locks.

BACKGROUND

Many properties are equipped with monitoring systems that include sensors and connected system components. Some monitoring systems include smart locks that may be operated remotely or through a keypad.

SUMMARY

Techniques are described for attempted entry detection. An attempted entry detection system can detect a person attempting to enter a locked door or window of a property. The system can use sensors incorporated into smart locks to detect an attempted entry, and can perform actions to prevent the entry and to notify a resident of the property.

Many residents and homeowners equip their properties with monitoring systems to enhance the security, safety, or convenience of their properties. The property monitoring systems can include smart locks, which can enable locking and unlocking of a door through operation of a keypad and/or through remote control.

Attempted entry sensors can be incorporated into a smart lock. Attempted entry sensors can include, for example, lever position sensors that can detect rotation of a door lever or doorknob. Attempted entry sensors can also include pressure sensors that can detect pressure of a person attempting to rotate a locked door lever or doorknob, or pressure from a person pushing steadily on the locked door. Attempted entry sensors can also include vibration sensors. For example, vibration sensors may be positioned on or near a deadbolt, in order to detect vibration of the deadbolt caused by a person shaking the locked door, e.g., alternating between pushing and pulling on the locked door.

Monitoring systems can dynamically control and configure devices and components of a property based on attempted entry detection. For example, the monitoring system can perform actions to reduce the likelihood of a person entering the property. Actions can include configuring components of the monitoring system to give the appearance of the property being occupied, e.g., turning on lights. In some examples, in response to detecting an attempted entry, the monitoring system can perform actions such as sending a notification to a mobile device of the resident of the property. In this way, the resident can be alerted to attempts made to enter the property while the doors are locked, the monitoring system is armed, or both.

Attempted entry detection can provide an additional layer of security for properties with monitoring systems while a property is occupied or unoccupied. For example, a person may attempt to enter a property at night while the resident is asleep. The monitoring system can detect the attempted entry and can send a visual and/or audible notification to the resident via a mobile device or via a component of the monitoring system, such as a control panel or doorbell chime. The monitoring system can also turn on indoor and outdoor lights at the property in order to give an appearance that the resident is home and awake. By turning on the lights, the monitoring system may also subtly wake and alert the resident to the attempted entry. In some examples, the monitoring system can activate surveillance cameras at the property in order to capture images of the person attempting to enter. The monitoring system can perform similar actions while the resident is away from the property in order to prevent unwanted entry to the unoccupied property.

In some examples, a monitoring server may collect data from multiple smart locks. The multiple smart locks may be installed in multiple doors of a single property and in doors of multiple properties. The monitoring server may analyze smart lock data from the multiple smart locks to determine if a person is attempting to enter multiple doors and/or multiple properties in a local area. In some examples, in response to detecting an attempted entry at a single property, the monitoring server may send commands to monitoring systems of one or more properties to activate surveillance cameras, turn on lights, etc., throughout the local area. Thus, monitoring systems with attempted entry detection can enhance security of a local area such as a neighborhood.

In some examples, the monitoring system can maintain a schedule of expected visitors and can correlate attempted entry data with the expected visitors. The schedule of expected visitors can include, for example, delivery services, dog walkers, maintenance personnel, friends, etc. The schedule may be provided by the resident, e.g., through an internet website or mobile application interface.

If an attempted entry occurs, the monitoring system may compare the attempted entry with the schedule of expected visitors to determine an identity of the person attempting to enter. For example, a package delivery may be scheduled for a certain time of day. When the delivery person arrives, the delivery person may attempt to enter the property. The monitoring system can determine that the person attempting to enter the property is the delivery person. The monitoring system can send an alert to the resident that the delivery person is attempting to enter the property. The resident may then choose to speak to the delivery person, e.g., through a microphone and speaker of a smart doorbell, or may choose to report the attempted entry to the delivery company.

In another example, a visitor such as a friend may be expected to visit at a certain date and time. When the friend arrives, the friend may attempt to enter the property. The monitoring system can determine that the person attempting to enter the property is the friend, based on the schedule. The monitoring system can send an alert to the resident that the friend is attempting to enter the property. The resident may then choose to send a command to the monitoring system to unlock the door for the friend.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
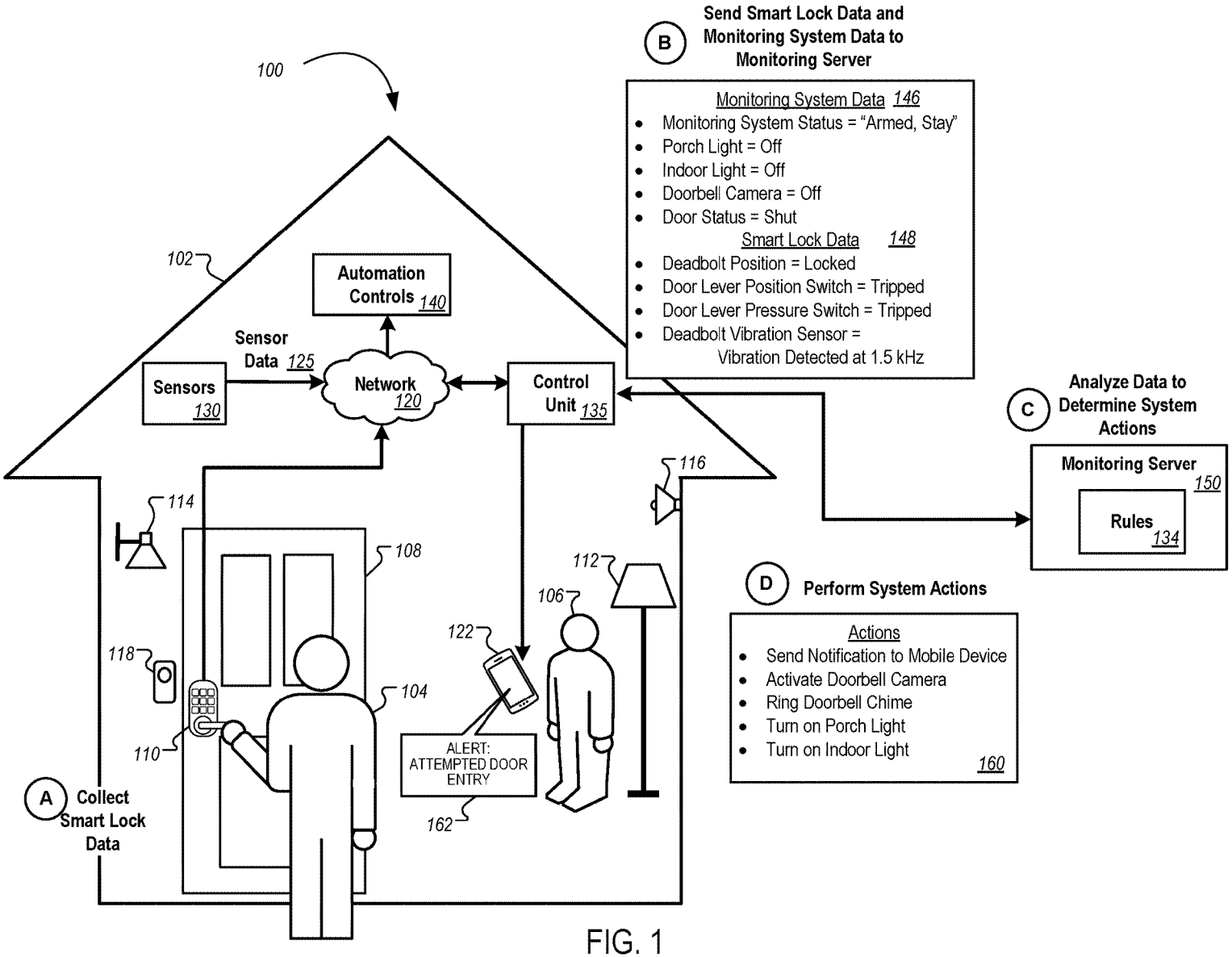
FIG. 1 shows a diagram illustrating an example system for attempted entry detection.

FIG. 1 shows a diagram illustrating an example system 100 for attempted entry detection.

A property 102 is monitored by a property monitoring system. The property 102 can be a home, another residence, a place of business, a public space, or another facility that has a smart lock 110 installed and is monitored by a monitoring system. The monitoring system includes a control unit 135, a network 120, and a remote monitoring server 150.

The property 102 includes a door 108 with a smart lock 110. To unlock the door 108 from outside of the property 102, a user, e.g., a resident 106 or another person 104, can enter a code into a keypad of the smart lock 110, turn a key in a keyhole of the smart lock 110, or send a remote command to the smart lock 110, e.g., via a mobile device 122. When the user enters the code, turns the key, or sends the remote command, the smart lock 110 can unlock by rotating a deadbolt out of a bore of a doorframe, by enabling a latch to be operated by a door lever, or both.

In some implementations, a state of the monitoring system and other events sensed by the monitoring system may be used to adjust components of the monitoring system. For example, sensors 130 of the monitoring system, including the smart lock 110, can be set to higher sensitivities when the monitoring system is in an "armed, away" state, and may be set to lower sensitivities when the alarm system is armed in an "armed, stay" state, or disarmed.

In some implementations, the sensors 130 can be set to lower sensitivities when the resident 106 is at or near the property 102, and can be set to higher sensitivities when the resident 106 is away from the property 102. The monitoring system may determine that the resident 106 is at or near the property 102 based on, e.g., motion sensor data or camera data indicating that the resident 106 is at the property 102. The monitoring system may also determine that the resident 106 is at or near the property 102 based on a global positioning system (GPS) location of the mobile device 122. The monitoring system may include a geofence, e.g., a programmed GPS range from the property 102. When the mobile device 122 is within the geofence, the monitoring system may determine that the resident 106 is at or near the property 102. When the mobile device 122 is outside of the geofence, the monitoring system may determine that the resident 106 is away from the property.

Figure 2:
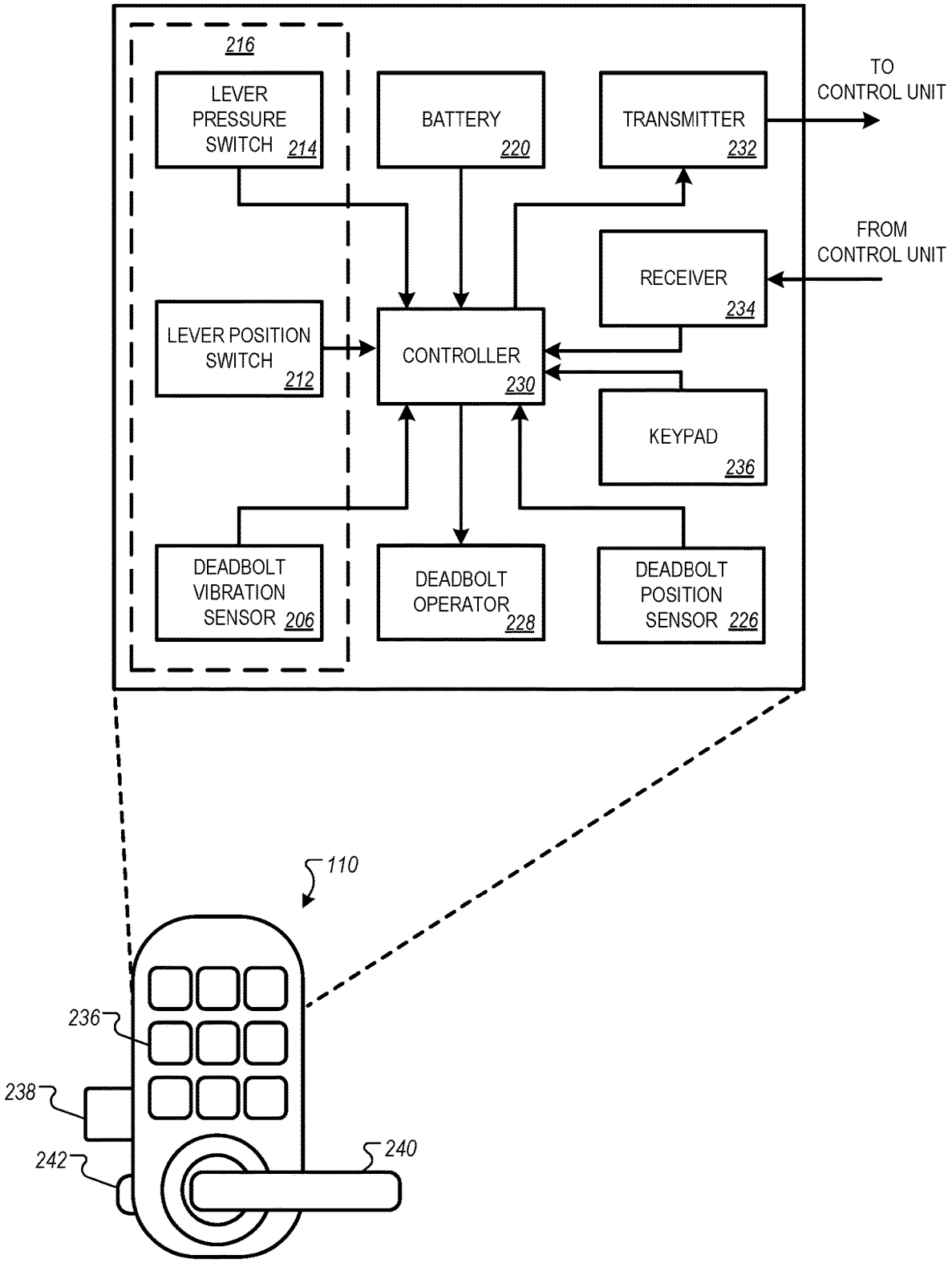
FIG. 2 shows a block diagram of an example smart lock.

FIG. 2 shows a block diagram of the example smart lock 110 of the door 108. The smart lock 110 includes attempted entry sensors 216 incorporated into the smart lock 110. The attempted entry sensors 216 can include one or more of a lever pressure switch 214, a lever position switch 212, and a deadbolt vibration sensor 206.

The smart lock 110 can include a lever 240, a latch 242, and a deadbolt 238. The lever 240 can control movement of the latch 242. In some implementations, the smart lock 110 may include the deadbolt 238, and might not include the lever 240 or the latch 242. In some implementations, the smart lock 110 may include the lever 240 and the latch 242, and might not include the deadbolt 238.

The smart lock 110 can include a deadbolt operator 228. The deadbolt operator 228 can lock or unlock the door 108 in response to user input to a keypad 236. The keypad 236 can include keys, or buttons, labeled with numbers and/or letters that enable user entry of alphanumeric codes. When a user enters a code that matches a preset code, the deadbolt operator 228 unlocks the door 108, e.g., by rotating the deadbolt 238 out of a bore of a doorframe. The deadbolt operator 228 can also lock or unlock the door 108 in response to remote control operation, e.g., a command sent through the network 120 from the control unit 135 of the monitoring system. Remote control operation can also include a command sent through the network 120 from a mobile device 122. The smart lock 110 can include a deadbolt position sensor 226 to determine that the door 108 is locked or unlocked.

The smart lock 110 can include a battery 220 for providing power to the smart lock 110. The battery 220 can be, for example, a rechargeable, non-rechargeable, or solar battery. The smart lock 110 can also include a controller 230 configured to control operations of the smart lock 110. The controller 230 can include one or more processors or microcontrollers. The smart lock 110 can also include a transmitter 232 and receiver 234 for communicating with the control unit 135 through the network 120 at the property 102.

The controller 230 can receive data from the attempted entry sensors 216 and send the data to the control unit 135 via the transmitter 232. The controller 230 can also receive a lock position status from the deadbolt position sensor 226 and send the lock position status to the control unit 135 via the transmitter 232. The controller 230 can also receive lock/unlock commands from the control unit 135 through the receiver 234, and send a signal to the deadbolt operator 228 to lock or unlock the door 108 in response to the command.

If a person attempts to open the door 108 while the door 108 is locked, the person will likely manipulate the lever 240 by pressing down or pulling up on the lever 240. The person may also push or pull the door 108. The attempted entry sensors 216 can collect data that reflects these actions, and send the data to the controller 230.

Specifically, the lever pressure switch 214 can be configured to detect a person manipulating the lever 240. The lever pressure switch 214 can measure a pressure applied to the lever 240. If the pressure exceeds a threshold pressure, the lever pressure switch can send pressure data to the controller 230. The threshold pressure may be calibrated to a specific pressure or a range of pressures that corresponds to typical force applied by a person attempting to open a door.

In some examples, the threshold pressure can be adjusted, e.g., by raising or lowering the threshold pressure. Raising the threshold pressure can result in a higher pressure required to trigger a monitoring system action. Raising the threshold pressure can therefore reduce a sensitivity of the lever pressure switch 214, reducing a likelihood of false alerts. In contrast, lowering the threshold pressure can result in a lower pressure required to trigger a monitoring system action. Lowering the threshold pressure can therefore increase a sensitivity of the lever pressure switch 214, providing additional security.

The controller 230 may determine to adjust the threshold pressure based on one or more factors. For example, the controller 230 may determine to adjust the threshold pressure based on receiving data from the control unit 135 or a sensor 130 indicating a change in one or more factors such as a time of day, a monitoring system status, an occupancy of the property 102, a status of a component of the monitoring system, or a location of the resident 106.

In some examples, the controller 230 may raise the threshold pressure during daytime, and lower the threshold pressure during nighttime. In some examples, the controller 230 may raise the threshold pressure when the monitoring system status is unarmed, and lower the threshold pressure when the monitoring system status is armed. In some examples, the controller 230 may raise the threshold pressure when the property 102 is occupied, and lower the threshold pressure when the property 102 is unoccupied. In some examples, the controller 230 may raise the threshold pressure when the resident is near the property 102, e.g., based on a GPS location of the mobile device 122, and lower the threshold pressure when the resident is away from the property 102.

In some examples, the lever pressure switch 214 can include a force sensitive resistor. The force sensitive resistor may be positioned at a point of friction between the lever 240 and an internal component of the smart lock 110, e.g., a latch assembly. When the person attempts to open the door 108 while the door 108 is locked, the lever 240 may exert pressure on the force sensitive resistor. When the force, or pressure, exceeds the threshold pressure, the lever pressure switch 214 can output the pressure data to the controller 230. In some examples, the pressure data can include a measured pressure or resistance magnitude. In some examples, the pressure data can include a "pressure trip" signal, representing the pressure exceeding the threshold pressure.

In some implementations, one or more pressure sensors may be positioned and calibrated to detect pressure applied to other components of the door 108 or the smart lock 110, in addition to or instead of the lever 240. For example, during an attempted entry, a person may press on the door 108, causing the deadbolt 238 or the latch 242 to apply pressure to the doorframe. A pressure sensor can be positioned to detect pressure applied from the deadbolt 238, the latch 242, or both, to the doorframe, e.g., to the bore of the doorframe. The pressure sensor can be calibrated to a pressure range corresponding to a typical pressure of a person pushing on the door 108.

The lever position switch 212 can also be configured to detect a person manipulating the lever 240. The lever position switch 212 may be installed in the smart lock 110 in addition to, or instead of, the lever pressure switch 214. The lever position switch 212 can be triggered by rotation of the lever 240 past a rotation limit. The lever position switch 212 may be any type of electrical or mechanical switch. When the lever 240 rotates past the rotation limit, the switch can turn on, and send a "rotation trip" signal to the controller 230.

In some implementations, rotational movement of the lever 240 may be restricted when the door 108 is locked. For example, a maximum rotation angle of the lever 240 may be ninety degrees when the door 108 is unlocked, but only twenty degrees when the door 108 is locked. The rotation limit can therefore be calibrated to a position that is between a resting position of zero degrees and the maximum rotation angle for the locked door 108. For example, the rotation limit may be set to a rotation angle of fifteen degrees. Thus, if the lever 240 rotates more than fifteen degrees while the door 108 is locked, the lever position switch 212 can send the rotation trip signal to the controller 230.

In some examples, the rotation limit can be adjusted, e.g., by increasing the rotation limit or decreasing the rotation limit. Increasing the rotation limit can result in a greater rotation angle required to trigger a monitoring system action. Increasing the rotation limit can therefore reduce a sensitivity of the lever position switch 212, reducing a likelihood of false alerts. In contrast, decreasing the rotation limit can result in a lesser rotation angle required to trigger a monitoring system action. Decreasing the rotation limit can therefore increase a sensitivity of the lever position switch 212, providing additional security.

The controller 230 may determine to adjust the rotation limit based on one or more factors. For example, the controller 230 may determine to adjust the rotation limit based on receiving data from the control unit 135 or a sensor 130 indicating a change in one or more factors such as a time of day, a monitoring system status, an occupancy of the property 102, or a status of a component of the monitoring system.

In some examples, the controller 230 may increase the rotation limit during daytime, and decrease the rotation limit during nighttime. In some examples, the controller 230 may increase the rotation limit when the monitoring system status is unarmed, and decrease the rotation limit when the monitoring system status is armed. In some examples, the controller 230 may increase the rotation limit when the property 102 is occupied, and decrease the rotation limit when the property 102 is unoccupied. In some examples, the controller 230 may increase the rotation limit when the resident 106 is near the property 102, and decrease the rotation limit when the resident 106 is away from the property 102.

The deadbolt vibration sensor 206 can measure vibration of the deadbolt 238. The deadbolt vibration sensor 206 can be, for example, a pin-and-spring sensor, a non-contact displacement sensor, or an accelerometer. The deadbolt vibration sensor 206 may measure an amplitude, frequency, or both, of vibration of the deadbolt 238.

For example, when a person pushes or pulls on the door 108, the deadbolt 238 may strike a faceplate positioned around the bore of the doorframe. When the deadbolt 238 strikes the faceplate, the deadbolt 238 may cause vibration at a certain frequency, or within a certain frequency range. The deadbolt vibration sensor 206 can be calibrated to a frequency range for the specific smart lock 110 in a specific installation location, e.g., the door 108 of the property 102.

In some examples, the frequency range can be adjusted, e.g., by narrowing or broadening the frequency range. Narrowing the frequency range can result in a more specific frequency required to trigger a monitoring system action. Narrowing the frequency range can therefore reduce a sensitivity of the deadbolt vibration sensor 206, reducing a likelihood of false alerts. In contrast, broadening the frequency range can result in a less specific frequency required to trigger a monitoring system action. Broadening the frequency range can therefore increase the sensitivity of the deadbolt vibration sensor 206, providing additional security.

The controller 230 may determine to adjust the frequency range based on one or more factors. For example, the controller 230 may determine to adjust the frequency range based on receiving data from the control unit 135 or a sensor 130 indicating a change in one or more factors such as a time of day, a monitoring system status, an occupancy of the property 102, or a status of a component of the monitoring system.

In some examples, the controller 230 may narrow the frequency range during daytime, and broaden the frequency range during nighttime. In some examples, the controller 230 may narrow the frequency range when the monitoring system status is unarmed, and broaden the frequency range when the monitoring system status is armed. In some examples, the controller 230 may narrow the frequency range when the property 102 is occupied, and broaden the frequency range when the property 102 is unoccupied. In some examples, the controller 230 may narrow the frequency range when the resident 106 is near the property 102, and broaden the frequency range when the resident 106 is away from the property 102. In some examples, the controller 230 may narrow the frequency range during poor weather conditions, e.g., during strong winds at the location of the property 102. The controller 230 may then broaden the frequency range during calm weather conditions at the location of the property 102.

The deadbolt vibration sensor 206 can measure the vibration of the deadbolt 238 striking the faceplate. When the vibration of the deadbolt 238 satisfies vibration criteria, e.g., the vibration falls within a certain frequency range, exceeds a threshold amplitude, or both, the deadbolt vibration sensor 206 can output vibration data to the controller 230. In some examples, the vibration data can include a measured frequency and amplitude of the vibration. In some examples, the vibration data can include a "vibration trip" signal, representing the vibration meeting the vibration criteria.

In some implementations, the deadbolt vibration sensor 206 may output the vibration data to the controller 230, and the controller 230 may determine whether the vibration data meets the vibration criteria. In some implementations, the smart lock 110 may output the vibration data to the control unit 135 or the monitoring server 150, and the control unit 135 or the monitoring server 150 may determine if the vibration data meets the vibration criteria.

In some implementations, one or more vibration sensors may be positioned and calibrated to detect vibration of other components of the door 108 or the smart lock 110, in addition to or instead of the deadbolt 238. For example, a sliding door may include a lock with a hook. When locked, the hook catches a keep installed in the doorframe. During an attempted entry, the hook may strike the keep. A vibration sensor can be positioned to detect vibration of the hook striking the keep, and can be calibrated to a frequency range corresponding to a typical vibration frequency of the hook striking the keep.

In some implementations, the attempted entry sensors 216 may be continuously active. For example, the attempted entry sensors 216 can detect lever manipulation, deadbolt vibration, or both, when the door 108 is locked and when the door 108 is unlocked. In some implementations, the attempted entry sensors 216 may be active only at certain times, e.g., when the door 108 is locked, when the monitoring system is armed, or when the door 108 is locked and the monitoring system is armed.

For example, when the deadbolt 238 moves from an unlocked position to a locked position, the deadbolt position sensor 226 can send a signal to the controller 230 indicating that the deadbolt 238 is in the locked position. The controller 230 can then activate the attempted entry sensors 216. In another example, when the monitoring system status changes from "unarmed" to "armed," the control unit 135 can send a signal to the controller 230 indicating the change in monitoring system status. The controller 230 can then activate the attempted entry sensors. When the door 108 unlocks, the monitoring system status changes to "unarmed," or both, the controller 230 can then deactivate the attempted entry sensors 216.

When the attempted entry sensors 216 are active, the controller 230 can receive data from the attempted entry sensors 216. The controller 230 can then send the data to the control unit 135 and/or the monitoring server 150 of the monitoring system. The control unit 135 or the monitoring server 150 can determine that the data indicates a person pushing on the lever 240 and/or pushing or pulling the door 108, and therefore indicates an attempted entry.

In addition to the smart lock 110, the monitoring system can include one or more additional sensors 130 located at the property 102 that collect sensor data 125 related to the property 102. The sensors 130 can include, for example, light sensors, surveillance cameras, and door and window lock sensors. The sensors 130 can send the sensor data 125 to the control unit 135 through the network 120.

The control unit 135 can also communicate with and control various devices on the property 102 through automation controls 140. Automation controls 140 can include, for example, indoor light 112 controls, porch light 114 controls, and a doorbell chime 116.

The control unit 135 can be, for example, a computer system or other electronic device configured to communicate with the smart lock 110 and the sensors 130. The control unit 135 can also perform various management tasks and functions for the monitoring system. In some implementations, the resident 106 of the property, or another user, can communicate with the control unit 135 (e.g., input data, view settings, or adjust parameters) through a physical connection, such as a control panel, using a touch screen, keypad, and/or a voice interface.

The smart lock 110 and the sensors 130 may communicate with the control unit 135 directly using short-range wireless communication protocols, or through the network 120. The network 120 can be any communication infrastructure that supports the electronic exchange of data between the control unit 135, the smart lock 110, and the sensors 130. For example, the network 120 may include a local area network (LAN). The network 120 may be any one or combination of wireless or wired networks and may include any one or more of Ethernet, Bluetooth, Bluetooth LE, Z-wave, Zigbee, or Wi-Fi technologies.

The monitoring server 150 can be, for example, one or more computer systems, server systems, or other computing devices that are located remotely from the property 102 and that are configured to process information related to the monitoring system at the property 102. In some implementations, the monitoring server 150 is a cloud computing platform.

The control unit 135 communicates with the monitoring server 150 via a long-range data link. For example, the control unit 135 can send monitoring system data 146 and smart lock data 148 to the monitoring server 150. The long-range data link can include any combination of wired and wireless data networks. For example, the control unit 135 can exchange information with the monitoring server 150 through a wide-area-network (WAN), a broadband internet connection, a cellular telephony network, a wireless data network, a cable connection, a digital subscriber line (DSL), a satellite connection, or other electronic means for data transmission. The control unit 135 and the monitoring server 150 may exchange information using any one or more of various communication synchronous or asynchronous protocols, including the 802.11 family of protocols, TCP/IP, GSM, 3G, 4G, 5G, LTE, CDMA-based data exchange or other techniques. In some implementations, the long-range data link between the control unit 135 and the monitoring server 150 is a secure data link (e.g., a virtual private network) such that the data exchanged between the control unit 135 and the monitoring server 150 is encoded to protect against interception by an adverse third party.

In some implementations, various monitoring system components located at the property 102 communicate directly with the monitoring server 150 (e.g., sending data directly to the monitoring server 150 rather than sending data to the monitoring server 150 via the control unit 135).

For example, the smart lock 110, the sensors 130, the automation controls 140, or other devices at the property 102 can provide some or all of the monitoring system data 146 and the smart lock data 148 to the monitoring server 150, e.g., through an internet connection.

In some implementations, the control unit 135 processes some or all of the monitoring system data 146 and the smart lock data 148 before sending the monitoring system data 146 and the smart lock data 148 to the monitoring server 150. For example, the control unit 135 may compress or encode the monitoring system data 146 and the smart lock data 148 to reduce the bandwidth required to support data transmission. The control unit 135 can also aggregate, filter, transform, or otherwise process some or all of the monitoring system data 146.

FIG. 1 includes stages (A) through (D), which represent a flow of data. In stage (A) of FIG. 1, the smart lock 110 collects smart lock data. The person 104 approaches the door 108 of the property 102 while the door 108 is locked and the monitoring system status is "armed, stay." The person 104 attempts to open the door 108.

When the person 104 attempts to open the door 108, the lever position switch 212 may detect rotation of the lever 240 past the rotation limit and send a rotation trip signal to the controller 230. The lever pressure switch 214 may detect a pressure increase caused by manipulation of the lever 240 and send a pressure trip signal to the controller 230. The deadbolt vibration sensor 206 may detect a vibration, and send vibration data to the controller 230.

The controller 230 can send smart lock data 148 to the control unit 135 over the network 120 through the transmitter 232. The smart lock data 148 can include, for example, a position of the deadbolt, door lever pressure data, door lever position data, and deadbolt vibration sensor data. The control unit 135 can receive the smart lock data 148 from the smart lock 110, and can also receive the sensor data 125 from the sensors 130.

In stage (B) of FIG. 1, the control unit 135 sends the monitoring system data 146 and the smart lock data 148 to the monitoring server 150. The monitoring system data 146 can include the status of the monitoring system. For example, the monitoring system may have status settings of "unarmed," "armed, stay," and "armed, away." In the example of FIG. 1, the monitoring system status is "armed, stay."

The monitoring system data 146 can also include surveillance camera footage, motion sensor data, microphone data, door and window position data, and light sensor data. For example, the monitoring system data 146 can include light sensor data indicating that the porch light 114 is off and the indoor light 112 is off. The monitoring system data 146 can also include data indicating that the doorbell camera 118 is off and the door 108 is shut.

The smart lock data 148 includes data indicating that the deadbolt is locked, the lever position switch 212 is tripped, and the lever pressure switch 214 is tripped. The smart lock data 148 also includes deadbolt vibration sensor data indicating that the deadbolt vibration sensor 206 detects a vibration frequency of 1.5 kHz.

In some examples, the control unit 135 may process some or all of the monitoring system data 146 and the smart lock data 148 before sending the monitoring system data 146 and the smart lock data 148 to the monitoring server 150. For example, the control unit 135 may analyze the deadbolt vibration sensor data to determine if the deadbolt vibration meets deadbolt vibration criteria.

In stage (C), the monitoring server 150 analyzes data to determine system actions. Specifically, the monitoring server 150 analyzes the smart lock data 148 and the monitoring system data 146 to determine that attempted entry is occurring.

The monitoring server 150 may determine that an attempted entry is occurring based on one or more rules 134. The rules 134 can include criteria for determining that an attempted entry is occurring. The rules 134 can also include prescribed system actions 160 for the monitoring system to take in response to detecting the attempted entry.

The rules can be default rules, set in advance by a system administrator. The rules 134 can also be custom rules, set or modified by the resident 106 or another authorized user of the monitoring system. The rules 134 may be general, such that they are applied to more than one property, or they may be specific to the particular property 102. In some implementations, the rules 134 can be customized according to a particular time of day or other factors.

In some examples, the rules 134 for determining that an attempted entry is occurring can include a deadbolt vibration sensor 206 detecting vibration within a programmed frequency range, above a programmed amplitude threshold, or both. When the deadbolt vibration sensor 206 detects vibration within the programmed frequency range, the monitoring server 150 can classify the deadbolt vibration sensor data as an indication of an attempted entry.

In the example of FIG. 1, the deadbolt vibration sensor data indicates the vibration frequency of 1.5 kHz. The monitoring server 150 may determine that the measured vibration frequency of 1.5 kHz is within a programmed frequency range, e.g., of 1.3 kHz to 1.7 kHz. In response to determining that the measured vibration frequency of 1.5 kHz is within the programmed frequency range, the monitoring server 150 can classify the deadbolt vibration as an indication of attempted entry.

In some examples, criteria for determining that an attempted entry is occurring can include any one of the attempted entry sensors 216 indicating an attempted entry. For example, the rules 134 may state that if the lever position switch 212 is tripped, the monitoring server 150 can determine that an attempted entry is occurring, even if the lever pressure switch 214 is not tripped and the deadbolt vibration sensor 206 does not detect vibration within the programmed frequency range.

In some examples, criteria for determining that an attempted entry is occurring can include a coincidence requirement for the attempted entry sensors 216. For example, the rules 134 may state that if any two out of three of the attempted entry sensors 216 indicate an attempted entry, the monitoring server 150 can determine that an attempted entry is occurring. In some examples, the rules 134 may state that the monitoring server 150 can determine that an attempted entry is occurring only if each of the attempted entry sensors 216 indicates an attempted entry.

In response to determining that an attempted entry is occurring, the monitoring server 150 can determine system actions 160 based on the rules 134 to. For example, the monitoring server 150 may determine actions 160 that include sending a notification to the mobile device 122, sending an instruction to the automation controls 140 to adjust a setting at the property 102, sending a command to a sensor 130 to collect and send additional sensor data 125, sounding an alarm of the property 102, or sending an alert to a third-party, such as security personnel or emergency services.

The rules 134 may prescribe the actions 160 that the monitoring system takes when there is an attempted entry. An example rule 134 may state that between the hours of 8:00 am and 8:00 pm, the monitoring system rings the doorbell chime 116 when there is an attempted entry. Another rule may state that between sunset and sunrise, the monitoring system turns on the porch light 114, the indoor light 112, or both, when there is an attempted entry. Another rule may be that the monitoring system always activates the doorbell camera 118 when there is an attempted entry.

The resident 106 can set rules regarding how and when the system sends notifications. For example, a rule 134 may state that the monitoring system always sends a notification to the mobile device 122 when there is an attempted entry. Another rule 134 may state that the monitoring system only sends an alert to the resident's mobile device 122 if there is an attempted entry when the monitoring status is "armed."

The resident 106 can further customize the one or more rules 134 according to his or her preferences. In some implementations, the resident 106 can set the one or more rules 134 through a software application executing on the mobile device 122, through a graphical interface provided by a browser or application on a computing device, and/or through interacting with a physical interface of the control unit 135 of the property monitoring system.

The rules 134 may vary depending on the monitoring system status. For example, a rule 134 may be that when the monitoring system status is "armed, stay," and the smart lock 110 detects an attempted entry, the monitoring system sends a notification to the control unit 135, activates the doorbell camera 118, and turns on the porch light 114, but does not ring the doorbell chime 116. Another example rule 134 may be that when the monitoring system status is "unarmed" and the smart lock 110 detects an attempted entry, the monitoring system turns on the indoor light 112 and rings the doorbell chime 116.

The rules 134 may vary depending on the door status and the deadbolt position. For example, in some cases the smart lock 110 may be locked by the latch 242, but not by the deadbolt 238. A rule 134 may be that when the deadbolt 238 is not locked and an attempted entry occurs, the monitoring system sends a command to the controller 230 via the receiver 234 to lock the deadbolt 238. The controller 230 can then lock the deadbolt 238 using the deadbolt operator 228.

In some examples, the monitoring server 150 can analyze the monitoring system data 146 and the smart lock data 148 to distinguish an attempted entry from other possible disturbances. For example, strong winds at the property may push the door 108 and cause the deadbolt 238 to strike the faceplate. The monitoring server 150 can use additional sensor data to determine if the deadbolt vibration is caused by an attempted entry or by weather effects.

The monitoring server 150 may receive weather data. The monitoring server 150 can receive the weather data, for example, over an internet connection. In some examples, the monitoring server 150 can receive the weather data from one or more sensors at the property 102, e.g., a thermometer, a barometer, or an anemometer. The monitoring server 150 can analyze the smart lock data 148 and the weather data to determine if changes in the smart lock data 148 correspond to changes in the weather data. The monitoring server 150 can then filter out smart lock data 148 that likely reflects changes in weather, rather than an attempted entry.

In some examples, the monitoring server 150 can distinguish between a weather disturbance and an attempted entry based on a length of time of the disturbance. For example, strong winds may push on the door 108 repeatedly over a time period of minutes or hours. In contrast, a person attempting to open the door 108 is not likely to continue the attempt for longer than several minutes. Therefore, the monitoring server 150 may filter out smart lock data 148 that continues or repeats for extended periods of time. In some examples, the monitoring server 150 can filter out smart lock data 148 that both coincides with changes in weather data and continues for extended periods of time.

In some examples, multiple smart locks may be installed in a local area. For example, the property 102 may include a smart lock on both the door 108 and another door of the property 102. In some examples, both the property 102 and another property within the local area may have smart locks installed. The monitoring server 150 may receive smart lock data 148 from the multiple smart locks in the local area. The monitoring server 150 can analyze the smart lock data 148 to distinguish an attempted entry from disturbances that may be affecting the local area. For example, strong winds may push multiple doors in the local area, causing deadbolt vibration for the multiple doors. The monitoring server 150 can therefore determine that the deadbolt vibration is likely caused by the strong winds, and can filter out the smart lock data 148 that likely reflects weather disturbances, rather than an attempted smart lock entry.

In some examples, the monitoring server 150 can activate additional sensors in order to differentiate an attempted entry from other disturbances. For example, upon receiving the smart lock data 148 indicating deadbolt vibration, the monitoring server 150 can send a command to the control unit 135 to activate the doorbell camera 118. The doorbell camera 118 can then record video images. Based on performing video analysis on the video images, the doorbell camera 118, the control unit 135, or the monitoring server 150 can determine whether a person is at the door 108 of the property. If the video images show the person 104 at the door 108, the monitoring server 150 can determine that the deadbolt vibration likely is due to an attempted entry. If the video images do not show the person 104, and instead show trees blowing in the wind, the monitoring server 150 can determine that the deadbolt vibration likely is due to weather disturbance.

In some examples, the monitoring server 150 can distinguish an attempted entry from another disturbance by using coincidence logic. For example, the monitoring server 150 can determine that an attempted entry is occurring based on coincidence between the deadbolt vibration sensor 206 and the lever position switch 212 both indicating the attempted entry. In some examples, the monitoring server 150 can determine that an attempted entry is occurring based on coincidence between the smart lock data 148 and other sensor data 125, e.g., motion sensor data that detects motion near the door 108, doorbell camera images of the person 104 approaching the door 108, etc.

In some implementations, the rules 134 can be programmed into the control unit 135 in addition to, or instead of, the monitoring server 150. In some implementations, the rules 134 can be programmed into the smart lock 110 or another local component of the monitoring system. The control unit 135, smart lock 110, or other local component may analyze the monitoring system data 146 and the smart lock data 148 and determine actions 160 based on the rules 134.

In stage (D) of FIG. 1, the monitoring server 150 performs system actions 160. For example, the monitoring server 150 can perform the actions 160 by sending a command to a component of the monitoring system through a signal to the control unit 135 over the long-range data link.

Specifically, the monitoring server 150 evaluates the monitoring system data 146 and the smart lock data 148 and determines that there is an attempted entry. Based on the rules 134 and the monitoring system status "armed, stay," the monitoring server 150 performs the system actions 160 of activating the doorbell camera 118, turning on the porch light 114, turning on the indoor light 112, ringing the doorbell chime 116, and sending a notification 162 to the mobile device 122. The notification 162 informs the resident 106 that an attempted entry is occurring. The notification 162 may also include, for example, an image of the person 104 captured by the doorbell camera 118.

Though described above as being performed by a particular component of system 100 (e.g., the control unit 135 or the monitoring server 150), any of the various control, processing, and analysis operations can be performed by either the control unit 135, the monitoring server 150, or another computer system of the system 100. For example, the control unit 135, the monitoring server 150, or another computer system can analyze the monitoring system data 146 from the smart lock 110 and sensors 130 to determine the actions 160. Similarly, the control unit 135, the monitoring server 150, or another computer system can control the various sensors 130, the smart lock 110, and/or the property automation controls 140 to collect data or control device operation.

Though described above as being installed in the door 108, which is a swinging door, attempted entry detection can also be used for various other types of accesses. For example, attempted entry detection can be used for detecting attempted entry through swinging windows, sliding windows, overhead doors, and sliding doors.

Figure 3:
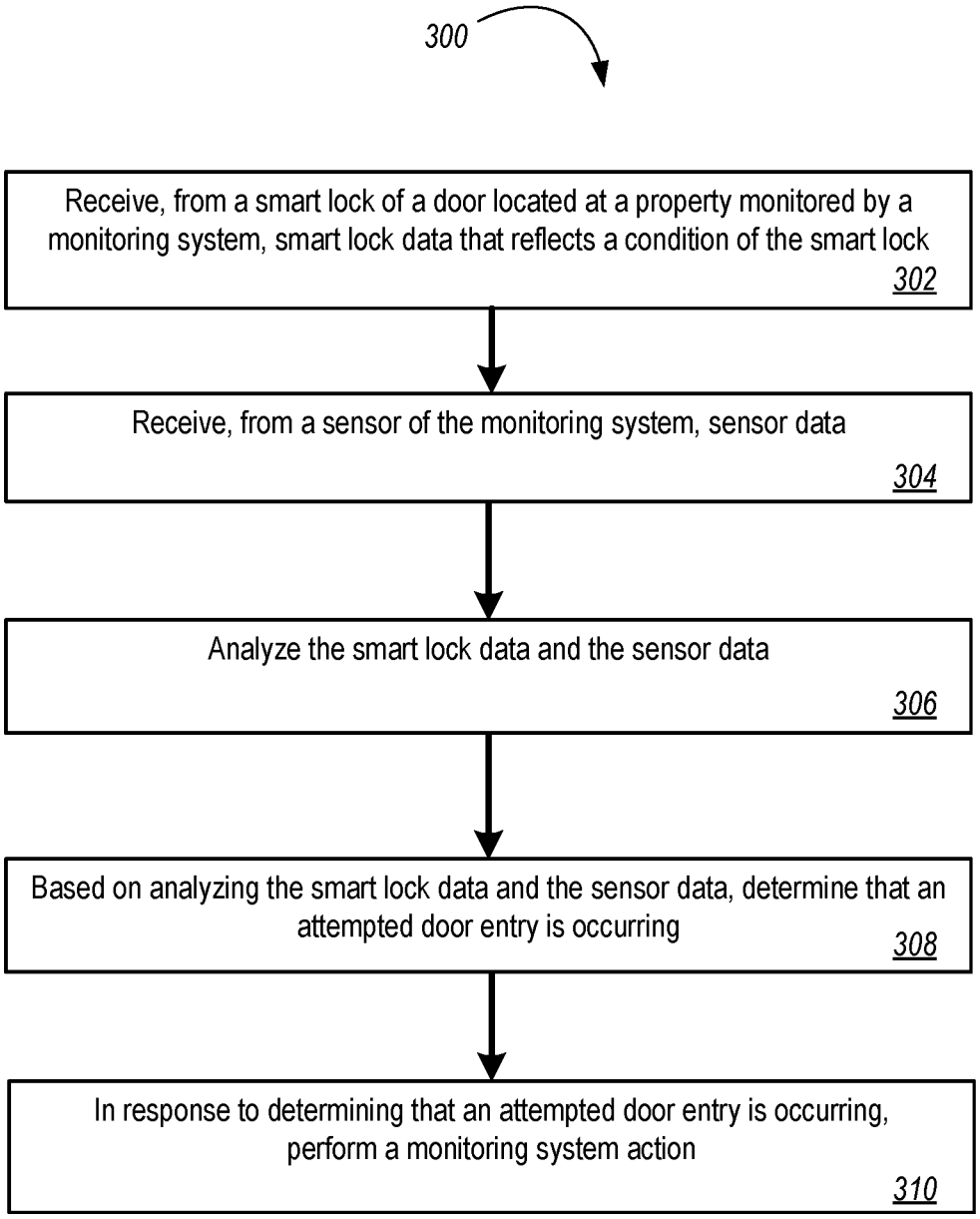
FIG. 3 shows a flow chart illustrating an example process for attempted entry detection.

FIG. 3 shows a flow chart illustrating an example process 300 for attempted entry detection. The process 300 is performed by a system or component of the property monitoring system. For example, the process 300 can be performed by the smart lock 110, the control unit 135, the monitoring server 150, or another computer system of the property monitoring system. In some examples, some steps of the process 300 can be performed by one component, e.g., the smart lock 110, and other steps of the process 300 can be performed by another component, e.g., the control unit 135.

Briefly, the process 300 includes receiving, from a smart lock located at a property monitored by a monitoring system, smart lock data that reflects a condition of the smart lock (302), receiving, from a sensor of the monitoring system, sensor data (304), analyzing the smart lock data and the sensor data (306), based on analyzing the smart lock data and the sensor data, determining that an attempted door entry is occurring (308), and in response to determining that the attempted door entry is occurring, performing a monitoring system action (310). In greater detail, the process 300 includes receiving, from a smart lock located at a property monitored by a monitoring system, smart lock data that reflects a condition of the smart lock (302). For example, the monitoring server 150 can receive smart lock data 148 via the control unit 135 or directly from the smart lock 110.

In some implementations, the smart lock data includes a locked or unlocked position of a door locking mechanism and data indicating one or more of: a pressure exerted on a door lever, a position of the door lever, or a vibration of the door locking mechanism. For example, the smart lock data can include a locked or unlocked condition of the smart lock 110, e.g., that the smart lock 110 is unlocked, or is locked with a deadbolt 238, a latch 242, or both.

The smart lock data can include data indicating a pressure exerted on a door lever, e.g., as measured by the lever pressure switch 214. For example, the smart lock data 148 can include data indicating that a lever pressure switch 214 is tripped. The smart lock data can include data indicating a position of the door lever, e.g., as measured by the lever position switch 212. For example, the smart lock data 148 can include data indicating that the lever position switch 212 is tripped. The smart lock data 148 can include data indicating vibration of the door locking mechanism, e.g., as measured by the deadbolt vibration sensor 206. For example, the smart lock data 148 can include data indicating that the deadbolt vibration sensor 206 detects vibration, data indicating a vibration frequency detected by the deadbolt vibration sensor 206, or both.

The process 300 includes receiving, from a sensor of the monitoring system, sensor data (304). For example, the monitoring server 150 can receive the sensor data 125 and the monitoring system status from the control unit 135. The sensor data 125 can include, for example, motion detector data from a motion sensor indicating motion near a door of the property. The sensor data 125 may also include camera image data showing images of a person near the property. The sensor data 125 may also include biometric sensor data indicating biometric data related to a person near the property. The sensor data 125 may include door sensor data indicating that one or more doors of the property are shut or open, and locked or unlocked.

The process 300 includes analyzing the smart lock data and the sensor data (306). For example, the monitoring server 150 can analyze the smart lock data 148 to determine if the door 108 is locked or unlocked, and if a vibration frequency detected by the deadbolt vibration sensor 206 is within a pre-programmed frequency range. The monitoring server 150 can analyze the sensor data 125 to determine if changes in smart lock data 148 likely reflect an attempted entry, or are likely caused by another disturbance, such as weather.

The process 300 includes based on analyzing the smart lock data and the sensor data determining that an attempted door entry is occurring (308).

In some implementations, determining that the attempted door entry is occurring includes determining, based on the sensor data, that a person is located near the smart lock; and determining, based on analyzing the smart lock data, that the smart lock data satisfies criteria for an attempted door entry.

In some implementations, the sensor includes a motion sensor and the sensor data includes motion sensor data. Determining that the person is located near the smart lock can include determining, based on the motion sensor data, that the motion sensor detected motion within a programmed range to the motion sensor. For example, the motion sensor may be programmed to detect motion within a programmed range of twelve feet to the smart lock 110. The motion sensor data may indicate that the motion sensor detected motion within the programmed range of twelve feet to the smart lock 110.

In some implementations, the sensor includes a camera and the sensor data includes camera image data. Determining that the person is located near the smart lock includes determining, based on the camera image data, that the camera captured an image of the person within a field of view of the camera. For example, the system may perform video analysis on images of the camera. Results of the video analysis can indicate the presence of a person within the camera image captured by the camera.

In some implementations, determining that the smart lock data satisfies criteria for an attempted door entry includes determining that the position of the door locking mechanism is in a locked position and determining that at least one of the pressure exerted on the door lever, the position of the door lever, or the vibration of the door locking mechanism satisfies criteria for an attempted door entry. For example, determining that the smart lock data satisfies criteria for an attempted door entry includes determining that the deadbolt 238 is in a locked position.

Determining that the smart lock data satisfies criteria for an attempted door entry can also include determining that the pressure exerted on the door lever 240 satisfies criteria for an attempted door entry. In some implementations, the smart lock data includes data indicating a pressure exerted on a door lever of the smart lock. Determining that the attempted door entry is occurring can include determining that the pressure exerted on the door lever of the smart lock is greater than a threshold pressure. For example, a threshold pressure may be 1.0 pounds per square inch (psi) of pressure exerted on the door lever 240. The system may determine that the exerted pressure satisfies criteria for an attempted door entry based on an exerted pressure of 1.5 psi exceeding the threshold pressure of 1.0 psi.

In some implementations, the smart lock data includes data indicating a rotational position of a door lever of the smart lock. Determining that the attempted door entry is occurring includes determining that the rotational position of the door lever exceeds a rotational position limit. For example, a rotational position limit may be set at a rotation of thirty degrees. Determining that the attempted door entry is occurring can include determining that the rotational position of the door lever 240 of forty degrees exceeds the rotational position limit of thirty degrees.

In some implementations, the smart lock data includes data indicating a vibration of a door locking mechanism of the smart lock. Determining that the attempted door entry is occurring can include determining that the vibration of the door lock mechanism satisfies vibration criteria for an attempted door entry.

In some implementations, the smart lock data includes data indicating a frequency of vibration of a door locking mechanism of the smart lock. Determining that the attempted door entry is occurring can include determining that the frequency of vibration of the door locking mechanism satisfies vibration frequency criteria for an attempted door entry. The vibration frequency criteria for an attempted door entry can include a frequency of vibration of the door locking mechanism within a programmed frequency band. For example, the programmed frequency band may be between 1.5 kHz and 2.0 kHz. Determining that the attempted door entry is occurring can include determining that the frequency of vibration of the door locking mechanism of 1.7 kHz is within the programmed frequency band of 1.5 kHz and 2.0 kHz.

In some implementations, the smart lock data includes data indicating an amplitude of vibration of a door locking mechanism of the smart lock. Determining that the attempted door entry is occurring includes determining that the amplitude of vibration of the door locking mechanism satisfies vibration amplitude criteria for an attempted door entry. The vibration amplitude criteria for an attempted door entry can include an amplitude of vibration of the door locking mechanism above a threshold vibration amplitude. For example, the threshold vibration amplitude may be a root mean square velocity amplitude of 12.0 millimeters per second (mm/s). Determining that the attempted door entry is occurring can include determining that the amplitude of vibration of the door locking mechanism of 14.0 mm/s exceeds the threshold amplitude of 12.0 mm/s.

In some implementations, the process 300 includes determining that the vibration of the door lock mechanism satisfies vibration criteria for an attempted door entry for a time duration greater than a threshold time duration. For example, a threshold time duration may be fifteen seconds. Determining that the vibration of the door lock mechanism satisfies vibration criteria for an attempted door entry can include determining that the vibration of the door lock mechanism satisfies vibration criteria for a time duration of sixteen seconds, greater than the threshold time duration of fifteen seconds.

In response to determining that the vibration of the door lock mechanism satisfies vibration criteria for an attempted door entry for a time duration greater than a threshold time duration, the process 300 can include determining that that the vibration of the door locking mechanism is likely caused by environmental effects. For example, vibration of the door may be caused by strong winds sustained over a period of time. Based on determining that the vibration of the door locking mechanism is likely caused by environmental effects, the process 300 can include determining that no attempted door entry is occurring.

In some examples, the monitoring server 150 may determine that an attempted entry is occurring based on one or more of the attempted entry sensors 216 indicating an attempted entry. The monitoring server 150 may determine that an attempted entry is occurring based on correlation between the smart lock data 148, the sensor data 125, and the monitoring system status. For example, the monitoring server 150 can determine that the door 108 is locked based on the smart lock data 148 and/or on a monitoring system status of "armed." The monitoring server 150 can then determine that a person is near the property based on the sensor data 125, and can determine that the person is likely attempting to enter the property based on the smart lock data 148.

The process 300 includes, in response to determining that the attempted door entry is occurring, performing a monitoring system action (310). For example, the monitoring server 150 can determine to perform actions 160 that include activating a sensor 130 at the property or adjusting a component of the monitoring system. In some examples, the monitoring system performs an action to collect additional data, e.g., activating a doorbell camera or microphone. In some examples, the monitoring system performs an action 160 that is intended to stop a person from attempting to enter the property. For example, the monitoring system may turn on one or more lights to signal to the person that a resident is at the property and is alert. Example actions 160 can also include sending a notification 162 to a resident of the property, whether the resident is at the property or is away from the property. The notification can inform the resident that a person is attempting to enter the property. In response to receiving the notification, the resident may take an action such as verifying other doors and windows of the property are shut and locked, communicating with the person, e.g., via the doorbell camera, or alerting authorities.

In some implementations, the process 300 can include receiving, from the monitoring system, a status of the monitoring system; and performing the monitoring system action based on the status of the monitoring system. For example, the status of the monitoring system may be "armed, stay," "armed, away," or "unarmed, stay." In some implementations, the system may perform a first monitoring system action based on a monitoring system status of "armed." For example, the system may send a notification to a user device of a resident of the property based on detecting an attempted door entry when the monitoring system status is armed. The system may perform a second, different monitoring system action based on a monitoring system status of "unarmed." For example, the system may activate a doorbell chime based on detecting an attempted door entry when the monitoring system is unarmed.

In some implementations, the process 300 includes receiving, from the smart lock, second smart lock data that reflects a condition of the smart lock; receiving, from a sensor of the monitoring system, second sensor data; analyzing the second smart lock data and the second sensor data; and based on analyzing the second smart lock data and the second sensor data, determining that no attempted door entry is occurring. For example, based on analyzing the second smart lock data, the system can determine that the second smart lock data does not satisfy criteria for an attempted door entry. In response to determining that no attempted door entry is occurring, the process 300 can include performing a second monitoring system action.

In some implementations, determining that no attempted door entry is occurring includes determining, based on the sensor data, that no person is located near the smart lock. For example, the system may determine that the second smart lock data satisfies criteria for an attempted door entry, but that the second sensor data does not indicate a person located near the smart lock 110. Based on the sensor data not indicating a person located near the smart lock 110, the system can determine that no door entry is occurring.

Figure 4:
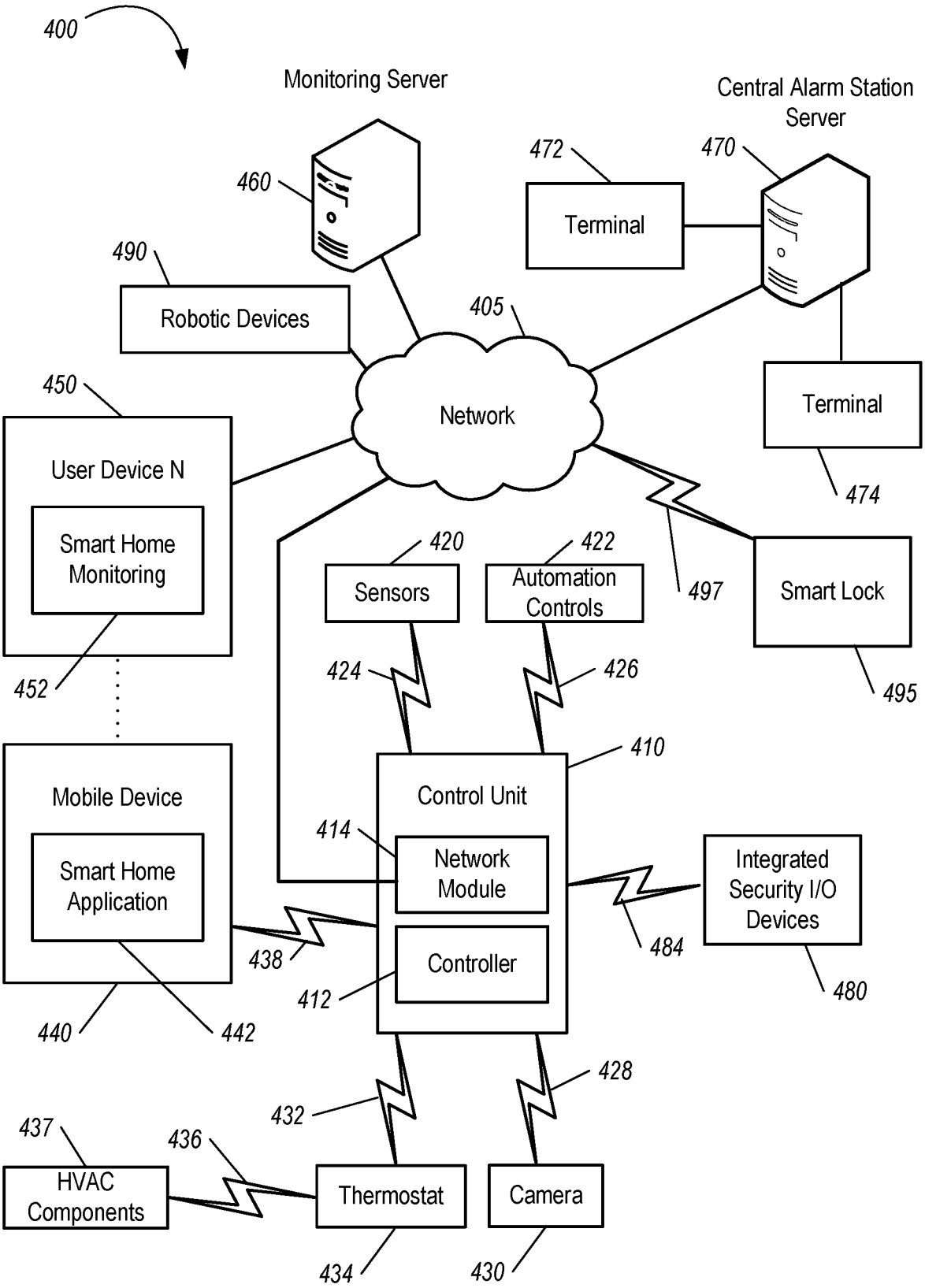
FIG. 4 shows a diagram illustrating an example of a property monitoring system.

FIG. 4 shows a diagram illustrating an example of a property monitoring system 400. The monitoring system 400 includes a network 405, a control unit 410, one or more user devices 440 and 450, a smart lock 495, a monitoring server 460, and a central alarm station server 470. In some examples, the network 405 facilitates communications between the control unit 410, the one or more user devices 440 and 450, the smart lock 495, the monitoring server 460, and the central alarm station server 470.

The network 405 is configured to enable exchange of electronic communications between devices connected to the network 405. For example, the network 405 may be configured to enable exchange of electronic communications between the control unit 410, the one or more user devices 440 and 450, the smart lock 495, the monitoring server 460, and the central alarm station server 470. The network 405 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 405 may include multiple networks or subnetworks, each of which may include, for example, a wired or wireless data pathway. The network 405 may include a circuit-switched network, a packet-switched data network, or any other network able to carry electronic communications (e.g., data or voice communications). For example, the network 405 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 405 may include one or more networks that include wireless data channels and wireless voice channels. The network 405 may be a wireless network, a broadband network, or a combination of networks including a wireless network and a broadband network.

The control unit 410 includes a controller 412 and a network module 414. The controller 412 is configured to control a control unit monitoring system (e.g., a control unit system) that includes the control unit 410. In some examples, the controller 412 may include a processor or other control circuitry configured to execute instructions of a program that controls operation of a control unit system. In these examples, the controller 412 may be configured to receive input from sensors, flow meters, or other devices included in the control unit system and control operations of devices included in the household (e.g., speakers, lights, doors, etc.). For example, the controller 412 may be configured to control operation of the network module 414 included in the control unit 410.

The network module 414 is a communication device configured to exchange communications over the network 405. The network module 414 may be a wireless communication module configured to exchange wireless communications over the network 405. For example, the network module 414 may be a wireless communication device configured to exchange communications over a wireless data channel and a wireless voice channel. In this example, the network module 414 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 414 also may be a wired communication module configured to exchange communications over the network 405 using a wired connection. For instance, the network module 414 may be a modem, a network interface card, or another type of network interface device. The network module 414 may be an Ethernet network card configured to enable the control unit 410 to communicate over a local area network and/or the Internet. The network module 414 also may be a voice band modem configured to enable the alarm panel to communicate over the telephone lines of Plain Old Telephone Systems (POTS).

The control unit system that includes the control unit 410 includes one or more sensors. For example, the monitoring system may include multiple sensors 420. The sensors 420 may include a lock sensor, a contact sensor, a motion sensor, or any other type of sensor included in a control unit system. The sensors 420 also may include an environmental sensor, such as a temperature sensor, a water sensor, a rain sensor, a wind sensor, a light sensor, a smoke detector, a carbon monoxide detector, an air quality sensor, etc. The sensors 420 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health-monitoring sensor can be a wearable sensor that attaches to a user in the home. The health-monitoring sensor can collect various health data, including pulse, heart rate, respiration rate, sugar or glucose level, bodily temperature, or motion data.

The sensors 420 can also include a radio-frequency identification (RFID) sensor that identifies a particular article that includes a pre-assigned RFID tag.

The control unit 410 communicates with the home automation controls 422 and a camera 430 to perform monitoring. The home automation controls 422 are connected to one or more devices that enable automation of actions in the home. For instance, the home automation controls 422 may be connected to one or more lighting systems and may be configured to control operation of the one or more lighting systems. In addition, the home automation controls 422 may be connected to one or more electronic locks at the home and may be configured to control operation of the one or more electronic locks (e.g., control Z-Wave locks using wireless communications in the Z-Wave protocol). Further, the home automation controls 422 may be connected to one or more appliances at the home and may be configured to control operation of the one or more appliances. The home automation controls 422 may include multiple modules that are each specific to the type of device being controlled in an automated manner. The home automation controls 422 may control the one or more devices based on commands received from the control unit 410. For instance, the home automation controls 422 may cause a lighting system to illuminate an area to provide a better image of the area when captured by a camera 430.

The camera 430 may be a video/photographic camera or other type of optical sensing device configured to capture images. For instance, the camera 430 may be configured to capture images of an area within a building or home monitored by the control unit 410. The camera 430 may be configured to capture single, static images of the area and also video images of the area in which multiple images of the area are captured at a relatively high frequency (e.g., thirty images per second). The camera 430 may be controlled based on commands received from the control unit 410.

The camera 430 may be triggered by several different types of techniques. For instance, a Passive Infra-Red (PIR) motion sensor may be built into the camera 430 and used to trigger the camera 430 to capture one or more images when motion is detected. The camera 430 also may include a microwave motion sensor built into the camera and used to trigger the camera 430 to capture one or more images when motion is detected. The camera 430 may have a "normally open" or "normally closed" digital input that can trigger capture of one or more images when external sensors (e.g., the sensors 420, PIR, door/window, etc.) detect motion or other events. In some implementations, the camera 430 receives a command to capture an image when external devices detect motion or another potential alarm event. The camera 430 may receive the command from the controller 412 or directly from one of the sensors 420.

In some examples, the camera 430 triggers integrated or external illuminators (e.g., Infra-Red, Z-wave controlled "white" lights, lights controlled by the home automation controls 422, etc.) to improve image quality when the scene is dark. An integrated or separate light sensor may be used to determine if illumination is desired and may result in increased image quality.

The camera 430 may be programmed with any combination of time/day schedules, system "arming state," or other variables to determine whether images should be captured or not when triggers occur. The camera 430 may enter a low-power mode when not capturing images. In this case, the camera 430 may wake periodically to check for inbound messages from the controller 412. The camera 430 may be powered by internal, replaceable batteries if located remotely from the control unit 410. The camera 430 may employ a small solar cell to recharge the battery when light is available. Alternatively, the camera 430 may be powered by the controller's 412 power supply if the camera 430 is co-located with the controller 412.

In some implementations, the camera 430 communicates directly with the monitoring server 460 over the Internet. In these implementations, image data captured by the camera 430 does not pass through the control unit 410 and the camera 430 receives commands related to operation from the monitoring server 460.

The system 400 also includes thermostat 434 to perform dynamic environmental control at the home. The thermostat 434 is configured to monitor temperature and/or energy consumption of an HVAC system associated with the thermostat 434, and is further configured to provide control of environmental (e.g., temperature) settings. In some implementations, the thermostat 434 can additionally or alternatively receive data relating to activity at a home and/or environmental data at a home, e.g., at various locations indoors and outdoors at the home. The thermostat 434 can directly measure energy consumption of the HVAC system associated with the thermostat, or can estimate energy consumption of the HVAC system associated with the thermostat 434, for example, based on detected usage of one or more components of the HVAC system associated with the thermostat 434. The thermostat 434 can communicate temperature and/or energy monitoring information to or from the control unit 410 and can control the environmental (e.g., temperature) settings based on commands received from the control unit 410.

In some implementations, the thermostat 434 is a dynamically programmable thermostat and can be integrated with the control unit 410. For example, the dynamically programmable thermostat 434 can include the control unit 410, e.g., as an internal component to the dynamically programmable thermostat 434. In addition, the control unit 410 can be a gateway device that communicates with the dynamically programmable thermostat 434. In some implementations, the thermostat 434 is controlled via one or more home automation controls 422.

A module 437 is connected to one or more components of an HVAC system associated with a home, and is configured to control operation of the one or more components of the HVAC system. In some implementations, the module 437 is also configured to monitor energy consumption of the HVAC system components, for example, by directly measuring the energy consumption of the HVAC system components or by estimating the energy usage of the one or more HVAC system components based on detecting usage of components of the HVAC system. The module 437 can communicate energy monitoring information and the state of the HVAC system components to the thermostat 434 and can control the one or more components of the HVAC system based on commands received from the thermostat 434.

In some examples, the system 400 further includes one or more robotic devices 490. The robotic devices 490 may be any type of robots that are capable of moving and taking actions that assist in home monitoring. For example, the robotic devices 490 may include drones that are capable of moving throughout a home based on automated control technology and/or user input control provided by a user. In this example, the drones may be able to fly, roll, walk, or otherwise move about the home. The drones may include helicopter type devices (e.g., quad copters), rolling helicopter type devices (e.g., roller copter devices that can fly and roll along the ground, walls, or ceiling) and land vehicle type devices (e.g., automated cars that drive around a home). In some cases, the robotic devices 490 may be devices that are intended for other purposes and merely associated with the system 400 for use in appropriate circumstances. For instance, a robotic vacuum cleaner device may be associated with the monitoring system 400 as one of the robotic devices 490 and may be controlled to take action responsive to monitoring system events.

In some examples, the robotic devices 490 automatically navigate within a home. In these examples, the robotic devices 490 include sensors and control processors that guide movement of the robotic devices 490 within the home. For instance, the robotic devices 490 may navigate within the home using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 490 may include control processors that process output from the various sensors and control the robotic devices 490 to move along a path that reaches the desired destination and avoids obstacles. In this regard, the control processors detect walls or other obstacles in the home and guide movement of the robotic devices 490 in a manner that avoids the walls and other obstacles.

In addition, the robotic devices 490 may store data that describes attributes of the home. For instance, the robotic devices 490 may store a floorplan and/or a three-dimensional model of the home that enables the robotic devices 490 to navigate the home. During initial configuration, the robotic devices 490 may receive the data describing attributes of the home, determine a frame of reference to the data (e.g., a home or reference location in the home), and navigate the home based on the frame of reference and the data describing attributes of the home. Further, initial configuration of the robotic devices 490 also may include learning of one or more navigation patterns in which a user provides input to control the robotic devices 490 to perform a specific navigation action (e.g., fly to an upstairs bedroom and spin around while capturing video and then return to a home charging base). In this regard, the robotic devices 490 may learn and store the navigation patterns such that the robotic devices 490 may automatically repeat the specific navigation actions upon a later request.

In some examples, the robotic devices 490 may include data capture and recording devices. In these examples, the robotic devices 490 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the home and users in the home. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 490 to take and store a biometric sample that can be used to identify the person (e.g., a biometric sample with DNA that can be used for DNA testing).

In some implementations, the robotic devices 490 may include output devices. In these implementations, the robotic devices 490 may include one or more displays, one or more speakers, and/or any type of output devices that allow the robotic devices 490 to communicate information to a nearby user.

The robotic devices 490 also may include a communication module that enables the robotic devices 490 to communicate with the control unit 410, each other, and/or other devices. The communication module may be a wireless communication module that allows the robotic devices 490 to communicate wirelessly. For instance, the communication module may be a Wi-Fi module that enables the robotic devices 490 to communicate over a local wireless network at the home. The communication module further may be a 900 MHz wireless communication module that enables the robotic devices 490 to communicate directly with the control unit 410. Other types of short-range wireless communication protocols, such as Bluetooth, Bluetooth LE, Z-wave, Zigbee, etc., may be used to allow the robotic devices 490 to communicate with other devices in the home. In some implementations, the robotic devices 490 may communicate with each other or with other devices of the system 400 through the network 405.

The robotic devices 490 further may include processor and storage capabilities. The robotic devices 490 may include any suitable processing devices that enable the robotic devices 490 to operate applications and perform the actions described throughout this disclosure. In addition, the robotic devices 490 may include solid-state electronic storage that enables the robotic devices 490 to store applications, configuration data, collected sensor data, and/or any other type of information available to the robotic devices 490.

The robotic devices 490 are associated with one or more charging stations. The charging stations may be located at predefined home base or reference locations in the home. The robotic devices 490 may be configured to navigate to the charging stations after completion of tasks needed to be performed for the monitoring system 400. For instance, after completion of a monitoring operation or upon instruction by the control unit 410, the robotic devices 490 may be configured to automatically fly to and land on one of the charging stations. In this regard, the robotic devices 490 may automatically maintain a fully charged battery in a state in which the robotic devices 490 are ready for use by the monitoring system 400.

The charging stations may be contact based charging stations and/or wireless charging stations. For contact based charging stations, the robotic devices 490 may have readily accessible points of contact that the robotic devices 490 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 490 may charge through a wireless exchange of power. In these cases, the robotic devices 490 need only locate themselves closely enough to the wireless charging stations for the wireless exchange of power to occur. In this regard, the positioning needed to land at a predefined home base or reference location in the home may be less precise than with a contact based charging station. Based on the robotic devices 490 landing at a wireless charging station, the wireless charging station outputs a wireless signal that the robotic devices 490 receive and convert to a power signal that charges a battery maintained on the robotic devices 490.

In some implementations, each of the robotic devices 490 has a corresponding and assigned charging station such that the number of robotic devices 490 equals the number of charging stations. In these implementations, the robotic devices 490 always navigate to the specific charging station assigned to that robotic device. For instance, a first robotic device may always use a first charging station and a second robotic device may always use a second charging station.

In some examples, the robotic devices 490 may share charging stations. For instance, the robotic devices 490 may use one or more community charging stations that are capable of charging multiple robotic devices 490. The community charging station may be configured to charge multiple robotic devices 490 in parallel. The community charging station may be configured to charge multiple robotic devices 490 in serial such that the multiple robotic devices 490 take turns charging and, when fully charged, return to a predefined home base or reference location in the home that is not associated with a charger. The number of community charging stations may be less than the number of robotic devices 490.

In addition, the charging stations may not be assigned to specific robotic devices 490 and may be capable of charging any of the robotic devices 490. In this regard, the robotic devices 490 may use any suitable, unoccupied charging station when not in use. For instance, when one of the robotic devices 490 has completed an operation or is in need of battery charge, the control unit 410 references a stored table of the occupancy status of each charging station and instructs the robotic device to navigate to the nearest charging station that is unoccupied.

The system 400 further includes one or more integrated security devices 480. The one or more integrated security devices may include any type of device used to provide alerts based on received sensor data. For instance, the one or more control units 410 may provide one or more alerts to the one or more integrated security input/output devices 480. Additionally, the one or more control units 410 may receive one or more sensor data from the sensors 420 and determine whether to provide an alert to the one or more integrated security input/output devices 480.

The sensors 420, the home automation controls 422, the camera 430, the thermostat 434, and the integrated security devices 480 may communicate with the controller 412 over communication links 424, 426, 428, 432, 438, and 484. The communication links 424, 426, 428, 432, 438, and 484 may be a wired or wireless data pathway configured to transmit signals from the sensors 420, the home automation controls 422, the camera 430, the thermostat 434, and the integrated security devices 480 to the controller 412. The sensors 420, the home automation controls 422, the camera 430, the thermostat 434, and the integrated security devices 480 may continuously transmit sensed values to the controller 412, periodically transmit sensed values to the controller 412, or transmit sensed values to the controller 412 in response to a change in a sensed value.

The communication links 424, 426, 428, 432, 438, and 484 may include a local network. The sensors 420, the home automation controls 422, the camera 430, the thermostat 434, and the integrated security devices 480, and the controller 412 may exchange data and commands over the local network. The local network may include 802.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CATS) or Category 6 (CAT6) wired Ethernet network. The local network may be a mesh network constructed based on the devices connected to the mesh network.

The monitoring server 460 is an electronic device configured to provide monitoring services by exchanging electronic communications with the control unit 410, the one or more user devices 440 and 450, and the central alarm station server 470 over the network 405. For example, the monitoring server 460 may be configured to monitor events generated by the control unit 410. In this example, the monitoring server 460 may exchange electronic communications with the network module 414 included in the control unit 410 to receive information regarding events detected by the control unit 410. The monitoring server 460 also may receive information regarding events from the one or more user devices 440 and 450.

In some examples, the monitoring server 460 may route alert data received from the network module 414 or the one or more user devices 440 and 450 to the central alarm station server 470. For example, the monitoring server 460 may transmit the alert data to the central alarm station server 470 over the network 405.

The monitoring server 460 may store sensor and image data received from the monitoring system and perform analysis of sensor and image data received from the monitoring system. Based on the analysis, the monitoring server 460 may communicate with and control aspects of the control unit 410 or the one or more user devices 440 and 450.

The monitoring server 460 may provide various monitoring services to the system 400. For example, the monitoring server 460 may analyze the sensor, image, and other data to determine an activity pattern of a resident of the home monitored by the system 400. In some implementations, the monitoring server 460 may analyze the data for alarm conditions or may determine and perform actions at the home by issuing commands to one or more of the controls 422, possibly through the control unit 410.

The monitoring server 460 can be configured to provide information (e.g., activity patterns) related to one or more residents of the home monitored by the system 400 (e.g., resident 106). For example, one or more of the sensors 420, the home automation controls 422, the camera 430, the thermostat 434, and the integrated security devices 480 can collect data related to a resident including location information (e.g., if the resident is home or is not home) and provide location information to the thermostat 434.

The central alarm station server 470 is an electronic device configured to provide alarm monitoring service by exchanging communications with the control unit 410, the one or more user devices 440 and 450, and the monitoring server 460 over the network 405. For example, the central alarm station server 470 may be configured to monitor alerting events generated by the control unit 410. In this example, the central alarm station server 470 may exchange communications with the network module 414 included in the control unit 410 to receive information regarding alerting events detected by the control unit 410. The central alarm station server 470 also may receive information regarding alerting events from the one or more user devices 440 and 450 and/or the monitoring server 460.

The central alarm station server 470 is connected to multiple terminals 472 and 474. The terminals 472 and 474 may be used by operators to process alerting events. For example, the central alarm station server 470 may route alerting data to the terminals 472 and 474 to enable an operator to process the alerting data. The terminals 472 and 474 may include general-purpose computers (e.g., desktop personal computers, workstations, or laptop computers) that are configured to receive alerting data from a server in the central alarm station server 470 and render a display of information based on the alerting data. For instance, the controller 412 may control the network module 414 to transmit, to the central alarm station server 470, alerting data indicating that a sensor 420 detected motion from a motion sensor via the sensors 420. The central alarm station server 470 may receive the alerting data and route the alerting data to the terminal 472 for processing by an operator associated with the terminal 472. The terminal 472 may render a display to the operator that includes information associated with the alerting event (e.g., the lock sensor data, the motion sensor data, the contact sensor data, etc.) and the operator may handle the alerting event based on the displayed information.

In some implementations, the terminals 472 and 474 may be mobile devices or devices designed for a specific function. Although FIG. 4 illustrates two terminals for brevity, actual implementations may include more (and, perhaps, many more) terminals.

The one or more authorized user devices 440 and 450 are devices that host and display user interfaces. For instance, the user device 440 is a mobile device that hosts or runs one or more native applications (e.g., the home monitoring application 442). The user device 440 may be a cellular phone or a non-cellular locally networked device with a display. The user device 440 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 440 may perform functions unrelated to the monitoring system, such as placing personal telephone calls, playing music, playing video, displaying pictures, browsing the Internet, maintaining an electronic calendar, etc.

The user device 440 includes a home monitoring application 442. The home monitoring application 442 refers to a software/firmware program running on the corresponding mobile device that enables the user interface and features described throughout. The user device 440 may load or install the home monitoring application 442 based on data received over a network or data received from local media. The home monitoring application 442 runs on mobile devices platforms, such as iPhone, iPod touch, Blackberry, Google Android, Windows Mobile, etc. The home monitoring application 442 enables the user device 440 to receive and process image and sensor data from the monitoring system.

The user device 440 may be a general-purpose computer (e.g., a desktop personal computer, a workstation, or a laptop computer) that is configured to communicate with the monitoring server 460 and/or the control unit 410 over the network 405. The user device 440 may be configured to display a smart home user interface 452 that is generated by the user device 440 or generated by the monitoring server 460. For example, the user device 440 may be configured to display a user interface (e.g., a web page) provided by the monitoring server 460 that enables a user to perceive images captured by the camera 430 and/or reports related to the monitoring system. Although FIG. 4 illustrates two user devices for brevity, actual implementations may include more (and, perhaps, many more) or fewer user devices.

In some implementations, the one or more user devices 440 and 450 communicate with and receive monitoring system data from the control unit 410 using the communication link 438. For instance, the one or more user devices 440 and 450 may communicate with the control unit 410 using various local wireless protocols such as Wi-Fi, Bluetooth, Z-wave, Zigbee, HomePlug (ethernet over power line), or wired protocols such as Ethernet and USB, to connect the one or more user devices 440 and 450 to local security and automation equipment. The one or more user devices 440 and 450 may connect locally to the monitoring system and its sensors and other devices. The local connection may improve the speed of status and control communications because communicating through the network 405 with a remote server (e.g., the monitoring server 460) may be significantly slower.

Although the one or more user devices 440 and 450 are shown as communicating with the control unit 410, the one or more user devices 440 and 450 may communicate directly with the sensors and other devices controlled by the control unit 410. In some implementations, the one or more user devices 440 and 450 replace the control unit 410 and perform the functions of the control unit 410 for local monitoring and long range/offsite communication.

In other implementations, the one or more user devices 440 and 450 receive monitoring system data captured by the control unit 410 through the network 405. The one or more user devices 440, 450 may receive the data from the control unit 410 through the network 405 or the monitoring server 460 may relay data received from the control unit 410 to the one or more user devices 440 and 450 through the network 405. In this regard, the monitoring server 460 may facilitate communication between the one or more user devices 440 and 450 and the monitoring system.

In some implementations, the one or more user devices 440 and 450 may be configured to switch whether the one or more user devices 440 and 450 communicate with the control unit 410 directly (e.g., through link 438) or through the monitoring server 460 (e.g., through network 405) based on a location of the one or more user devices 440 and 450. For instance, when the one or more user devices 440 and 450 are located close to the control unit 410 and in range to communicate directly with the control unit 410, the one or more user devices 440 and 450 use direct communication. When the one or more user devices 440 and 450 are located far from the control unit 410 and not in range to communicate directly with the control unit 410, the one or more user devices 440 and 450 use communication through the monitoring server 460.

Although the one or more user devices 440 and 450 are shown as being connected to the network 405, in some implementations, the one or more user devices 440 and 450 are not connected to the network 405. In these implementations, the one or more user devices 440 and 450 communicate directly with one or more of the monitoring system components and no network (e.g., Internet) connection or reliance on remote servers is needed.

In some implementations, the one or more user devices 440 and 450 are used in conjunction with only local sensors and/or local devices in a house. In these implementations, the system 400 includes the one or more user devices 440 and 450, the sensors 420, the home automation controls 422, the camera 430, and the robotic devices 490. The one or more user devices 440 and 450 receive data directly from the sensors 420, the home automation controls 422, the camera 430, and the robotic devices 490, and sends data directly to the sensors 420, the home automation controls 422, the camera 430, and the robotic devices 490. The one or more user devices 440, 450 provide the appropriate interfaces/processing to provide visual surveillance and reporting.

In other implementations, the system 400 further includes network 405 and the sensors 420, the home automation controls 422, the camera 430, the thermostat 434, and the robotic devices 490, and are configured to communicate sensor and image data to the one or more user devices 440 and 450 over network 405 (e.g., the Internet, cellular network, etc.). In yet another implementation, the sensors 420, the home automation controls 422, the camera 430, the thermostat 434, and the robotic devices 490 (or a component, such as a bridge/router) are intelligent enough to change the communication pathway from a direct local pathway when the one or more user devices 440 and 450 are in close physical proximity to the sensors 420, the home automation controls 422, the camera 430, the thermostat 434, and the robotic devices 490 to a pathway over network 405 when the one or more user devices 440 and 450 are farther from the sensors 420, the home automation controls 422, the camera 430, the thermostat 434, and the robotic devices 490.

In some examples, the system leverages GPS information from the one or more user devices 440 and 450 to determine whether the one or more user devices 440 and 450 are close enough to the sensors 420, the home automation controls 422, the camera 430, the thermostat 434, and the robotic devices 490 to use the direct local pathway or whether the one or more user devices 440 and 450 are far enough from the sensors 420, the home automation controls 422, the camera 430, the thermostat 434, and the robotic devices 490 that the pathway over network 405 is required.

In other examples, the system leverages status communications (e.g., pinging) between the one or more user devices 440 and 450 and the sensors 420, the home automation controls 422, the camera 430, the thermostat 434, and the robotic devices 490 to determine whether communication using the direct local pathway is possible. If communication using the direct local pathway is possible, the one or more user devices 440 and 450 communicate with the sensors 420, the home automation controls 422, the camera 430, the thermostat 434, and the robotic devices 490 using the direct local pathway. If communication using the direct local pathway is not possible, the one or more user devices 440 and 450 communicate with the sensors 420, the home automation controls 422, the camera 430, the thermostat 434, and the robotic devices 490 using the pathway over network 405.

In some implementations, the system 400 provides end users with access to images captured by the camera 430 to aid in decision making. The system 400 may transmit the images captured by the camera 430 over a wireless WAN network to the user devices 440 and 450. Because transmission over a wireless WAN network may be relatively expensive, the system 400 can use several techniques to reduce costs while providing access to significant levels of useful visual information (e.g., compressing data, down-sampling data, sending data only over inexpensive LAN connections, or other techniques).

In some implementations, a state of the monitoring system and other events sensed by the monitoring system may be used to enable/disable video/image recording devices (e.g., the camera 430). In these implementations, the camera 430 may be set to capture images on a periodic basis when the alarm system is armed in an "away" state, but set not to capture images when the alarm system is armed in a "home" state or disarmed. In addition, the camera 430 may be triggered to begin capturing images when the alarm system detects an event, such as an alarm event, a door-opening event for a door that leads to an area within a field of view of the camera 430, or motion in the area within the field of view of the camera 430. In other implementations, the camera 430 may capture images continuously, but the captured images may be stored or transmitted over a network when needed.

The system 400 further includes the smart lock 495. The smart lock 495 is shown as being connected to the network 405 through a communication link 497, which similarly to as described above in regards to communication links 424, 426, 428, 432, 438, and 484, may be wired or wireless. In some implementations, the smart lock 495 is not connected to the network 405. In these implementations, the smart lock 495 communicates directly with one or more of the monitoring system components, e.g., the smart lock 495 communicates directly with the control unit 410. In some implementations, the smart lock 495 may be configured to switch whether the smart lock 495 communicates with the control unit 410 directly or through the monitoring server 460 (e.g., through network 405) based on availability of the network 405. The smart lock 495 may be the smart lock 110, the control unit 410 may be the control unit 135, the sensors 420 may include the sensors 130, the automation controls 422 may include the automation controls 140, and the monitoring server 460 may be the monitoring server 150.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device.

Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A computer-implemented method comprising:

receiving, from a smart lock configured to control operation of a door locking mechanism at a property monitored by a monitoring system including one or more sensors, smart lock data, wherein the smart lock data is generated by at least one integrated sensor of the smart lock and indicates a first condition of the smart lock;

determining that the smart lock data satisfies criteria for a door entry attempt;

based on determining that the smart lock data satisfies criteria for a door entry attempt, determining that a door entry attempt is likely occurring;

in response to determining that the door entry attempt is likely occurring, performing a first action using the smart lock data;

receiving, from the smart lock, second smart lock data that indicates a second condition of the smart lock;

receiving, from a sensor of the monitoring system, sensor data;

based on the second smart lock data and the sensor data, determining that a door entry attempt is not likely occurring; and in response to determining that a door entry attempt is not likely occurring, performing a second action using the second smart lock data and the sensor data.

2. The method of claim 1, wherein the criteria for a door entry attempt comprises at least one of:

a pressure limit of pressure exerted on a door lever of the smart lock;

a rotational position limit of the door lever of the smart lock; or a vibration amplitude limit of the door locking mechanism.

3. The method of claim 2, wherein the smart lock data indicates one or more of:

a pressure exerted on the door lever, a rotational position of the door lever, or a vibration amplitude of the door locking mechanism.

4. The method of claim 2, wherein the criteria for a door entry attempt further comprises the door locking mechanism being in a locked position.

5. The method of claim 1, wherein:

the integrated sensor comprises a pressure switch;

the smart lock data comprises data generated by the pressure switch indicating a pressure exerted on a door lever of the smart lock; and determining that the smart lock data satisfies criteria for a door entry attempt comprises determining that the pressure exerted on the door lever of the smart lock is greater than a threshold pressure.

6. The method of claim 1, wherein:

the integrated sensor comprises a position switch;

the smart lock data comprises data generated by the position switch indicating a rotational position of a door lever of the smart lock; and determining that the smart lock data satisfies criteria for a door entry attempt comprises determining that the rotational position of the door lever exceeds a rotational position limit.

7. The method of claim 1, wherein:

the integrated sensor comprises a vibration sensor;

the smart lock data comprises data generated by the vibration sensor indicating a vibration of the door locking mechanism; and determining that the smart lock data satisfies criteria for a door entry attempt comprises determining that the vibration of the door locking mechanism satisfies vibration criteria for a door entry attempt.

8. A computer-implemented method comprising:

receiving, from a smart lock configured to control operation of a door locking mechanism, smart lock data, wherein the smart lock data (i) is generated by a vibration sensor integrated with the smart lock and (ii) indicates a vibration of the door locking mechanism;

determining that the vibration of the door locking mechanism satisfies vibration criteria for a door entry attempt;

based on determining that the vibration of the door locking mechanism satisfies vibration criteria for a door entry attempt, determining that a door entry attempt is likely occurring;

in response to determining that the door entry attempt is likely occurring, performing an action using the smart lock data;

determining that the vibration of the door locking mechanism satisfies vibration criteria for a door entry attempt for a time duration greater than a threshold time duration;

in response to determining that the vibration of the door locking mechanism satisfies vibration criteria for a door entry attempt for a time duration greater than a threshold time duration, determining that that the vibration of the door locking mechanism is likely caused by environmental effects; and based on determining that the vibration of the door locking mechanism is likely caused by environmental effects, determining that no door entry attempt is occurring.

9. The method of claim 1, wherein:

the integrated sensor comprises a vibration sensor;

the smart lock data comprises data generated by the vibration sensor indicating a frequency of vibration of a door locking mechanism of the smart lock; and determining that the smart lock data satisfies criteria for a door entry attempt comprises determining that the frequency of vibration of the door locking mechanism satisfies vibration frequency criteria for a door entry attempt.

10. The method of claim 9, wherein the vibration frequency criteria for a door entry attempt comprises a frequency of vibration of the door locking mechanism within a programmed frequency band.

11. The method of claim 1, wherein:

the integrated sensor comprises a vibration sensor;

the smart lock data comprises data generated by the vibration sensor indicating an amplitude of vibration of a door locking mechanism of the smart lock; and determining that the smart lock data satisfies criteria for a door entry attempt comprises determining that the amplitude of vibration of the door locking mechanism satisfies vibration amplitude criteria for a door entry attempt.

12. The method of claim 11, wherein the vibration amplitude criteria for a door entry attempt comprises an amplitude of vibration of the door locking mechanism above a threshold vibration amplitude.

13. The method of claim 1, wherein determining that a door entry attempt is not likely occurring comprises determining, based on the sensor data, that no person is located near the smart lock.

14. The method of claim 1, wherein the first action comprises providing an instruction to one or more devices to one or more of activate a doorbell chime, lock one or more doors, lock one or more windows, activate a camera to record images of an area near the door, or illuminate the area near the door.

15. A monitoring system comprising one or more computers configured to perform operations comprising:

receiving, from a smart lock configured to control operation of a door locking mechanism at a property monitored by the monitoring system, smart lock data, wherein the smart lock data is generated by at least one integrated sensor of the smart lock and indicates a first condition of the smart lock;

determining that the smart lock data satisfies criteria for a door entry attempt;

based on determining that the smart lock data satisfies criteria for a door entry attempt, determining that a door entry attempt is likely occurring;

in response to determining that the door entry attempt is likely occurring, performing action a first action using the smart lock data;

receiving, from the smart lock, second smart lock data that indicates a second condition of the smart lock;

receiving, from a sensor of the monitoring system, sensor data;

based on the second smart lock data and the sensor data, determining that a door entry attempt is not likely occurring; and in response to determining that a door entry attempt is not likely occurring, performing a second action using the second smart lock data and the sensor data.

16. A non-transitory computer-readable medium storing software comprising instructions executable by one or more computers which, upon such execution, cause the one or more computers to perform operations comprising:

receiving, from a smart lock configured to control operation of a door locking mechanism at a property monitored by a monitoring system including one or more sensors, smart lock data, wherein the smart lock data is generated by at least one integrated sensor of the smart lock and indicates a first condition of the smart lock;

determining that the smart lock data satisfies criteria for a door entry attempt;

based on determining that the smart lock data satisfies criteria for a door entry attempt, determining that a door entry attempt is likely occurring;

in response to determining that the door entry attempt is likely occurring, performing a first action using the smart lock data;

receiving, from the smart lock, second smart lock data that indicates a second condition of the smart lock;

receiving, from a sensor of the monitoring system, sensor data;

based on the second smart lock data and the sensor data, determining that a door entry attempt is not likely occurring; and in response to determining that a door entry attempt is not likely occurring, performing a second action using the second smart lock data and the sensor data.

17. The system of claim 15, wherein the criteria for a door entry attempt comprises at least one of:

a pressure limit of pressure exerted on a door lever of the smart lock;

a rotational position limit of the door lever of the smart lock; or a vibration amplitude limit of the door locking mechanism.

18. The system of claim 17, wherein the smart lock data indicates one or more of:

a pressure exerted on the door lever, a rotational position of the door lever, or a vibration amplitude of the door locking mechanism.

19. The method of claim 1, wherein the at least one integrated sensor comprises at least one of:

a pressure switch configured to measure pressure applied to a door lever of the smart lock;

a position switch configured to measure a rotational position of the door lever of the smart lock; or a vibration sensor configured to measure vibration amplitude of the door locking mechanism.

* * * * *